US009505472B2

(12) United States Patent
Kalliomäki

(10) Patent No.: US 9,505,472 B2
(45) Date of Patent: Nov. 29, 2016

(54) APPARATUS AND METHOD FOR TREATING AN UNDERWATER SURFACE

(71) Applicant: DG-Diving Group Ltd., Turku (FI)

(72) Inventor: Mauri Kalliomäki, Turku (FI)

(73) Assignee: DG-DIVING GROUP LTD., Turku (FI)

( * ) Notice: Subject to any disclaimer, the term of this patent is extended or adjusted under 35 U.S.C. 154(b) by 0 days.

(21) Appl. No.: 14/896,925

(22) PCT Filed: Jun. 6, 2014

(86) PCT No.: PCT/FI2014/050462
§ 371 (c)(1),
(2) Date: Dec. 9, 2015

(87) PCT Pub. No.: WO2014/199013
PCT Pub. Date: Dec. 18, 2014

(65) Prior Publication Data

US 2016/0137277 A1 May 19, 2016

(30) Foreign Application Priority Data

Jun. 13, 2013 (FI) ..... 20135647

(51) Int. Cl.

| | |
|---|---|
| ***B63B 59/08*** | (2006.01) |
| ***B08B 1/04*** | (2006.01) |
| ***A46B 13/02*** | (2006.01) |
| *A46B 13/00* | (2006.01) |
| *E02B 17/00* | (2006.01) |

(52) U.S. Cl.
CPC ..... *B63B 59/08* (2013.01); *A46B 13/02* (2013.01); *B08B 1/04* (2013.01); *A46B 13/008* (2013.01); *E02B 17/0034* (2013.01)

(58) Field of Classification Search
CPC . B63B 59/06; B63B 2059/065; B63B 59/08; B63B 2059/082; B63B 2059/085; B63B 2059/087; B63B 59/10; A46B 13/001; A46B 13/003; A46B 13/005; A46B 13/006; A46B 13/008; A46B 13/02; A46B 13/023; A46B 13/026; A46B 13/04; A46B 13/06
See application file for complete search history.

(56) References Cited

U.S. PATENT DOCUMENTS

| | | | | |
|---|---|---|---|---|
| 2008/0172822 | A1* | 7/2008 | Oh | A46B 13/008 15/349 |
| 2012/0006244 | A1 | 1/2012 | Van Rompay | |
| 2014/0116316 | A1* | 5/2014 | Fontaine | B63B 59/08 114/222 |
| 2015/0307169 | A1* | 10/2015 | Hojer | B63B 59/08 114/337 |

FOREIGN PATENT DOCUMENTS

| | | | |
|---|---|---|---|
| DE | 4226681 | A1 | 2/1994 |
| EP | 1162032 | A2 | 12/2001 |

(Continued)

OTHER PUBLICATIONS

FI20135647 Search Report, Patentti-ja rekisterihallitus, Mar. 10, 2014.

*Primary Examiner* — Andrew Polay
(74) *Attorney, Agent, or Firm* — Berggren, Inc.

(57) ABSTRACT

An apparatus and method for treating an underwater surface, said apparatus including an enclosure which is fitted with two brush members rotating in directions opposite to each other and equipped with bristles. The enclosure has a discharge opening for relieving the enclosure of matter removed from an underwater surface. The discharge opening can be accompanied by a collection arrangement for gathering the matter removed from an underwater surface. For effective collection and suction effect, the brush members are arranged in such a way that, as the brush members are rotating, the bristles thereof are at least in partial contact with each other in a given contact zone, and in such a way that the brush members have a rotating direction which in the contact zone is towards the discharge opening included in the enclosure. In addition, the enclosure is provided with a skirt portion, which encircles the brush members and extends to a location at the discharge opening from both sides thereof.

14 Claims, 2 Drawing Sheets

(56) References Cited

FOREIGN PATENT DOCUMENTS

| | | | |
|---|---|---|---|
| FR | 2534548 | A1 | 4/1984 |
| GB | 2131288 | A | 6/1984 |
| IE | 44201 | B1 | 9/1981 |
| JP | S5361897 | A | 6/1978 |
| RU | 2098315 | C1 | 12/1997 |
| WO | 2011015786 | A1 | 2/2011 |
| WO | 2013001015 | A1 | 1/2013 |

* cited by examiner

APPARATUS AND METHOD FOR TREATING AN UNDERWATER SURFACE

PRIORITY

This application is a national application of PCT-application PCT/FI2014/050462, filed on Jun. 6, 2014 and claiming priority of the Finnish national application number FI20135647 filed on Jun. 13, 2013, both of which are incorporated herein by reference.

TECHNICAL FIELD

The invention relates to an apparatus for treating an underwater surface, said apparatus comprising an enclosure, two brush members fitted in the enclosure, arranged to rotate in directions opposite to each other and equipped with bristles, and a discharge opening provided in the enclosure for relieving the enclosure of matter removed from the underwater surface, according to the pre-characterizing portion of claim 1. The invention also relates to a method for treating an underwater surface, according to the pre-characterizing portion of claim 10.

PRIOR ART

The treatment of underwater surfaces with various types of brush equipment is previously known. Such an underwater surface can be for example the side or bottom of a marine vessel, from which it is desirable to remove bottom vegetation and organism built up thereon. Such fouling generates a lot of friction as the vessel moves in water, thus also increasing considerably the vessel's fuel consumption. Should this type of bottom vegetation and organism not be thoroughly removed, another consequence may also be the unwanted spread of non-indigenous species.

Such underwater surfaces have also often involved the use of coatings or paints, which are released in the process of cleaning the surfaces and cause chemical water pollution.

It is also obvious that increasingly stringent environmental regulations impose inherent restrictions regarding the treatment of underwater surfaces.

Prior known brush devices have been presented in numerous publications. For example, documents FR 2 534 548, WO 2011/015786 A1, and JP S5361897 A disclose a piece of equipment provided with two brushes. Similar type three-brush devices are known for example from documents GB 2 131 288 and US 2012/0006244 A1. A single-brush device is known for example from document US 2004/0194237 A1.

These pieces of equipment include not only brush devices but also a separate vacuum-generating suction device, which is intended for recovering the brushed-off matter and water around it, and which utilizes the suction effect in an effort to hold the device against a surface to be cleaned. First of all, these pieces of equipment are quite complicated because of separate brush and suction devices and, on the other hand, the matter being removed from an underwater surface finds an easy way of spreading to the surroundings by way of the sides of the devices.

SUMMARY OF THE INVENTION

An objective of the present invention is to eliminate the prior art problems and to provide a simple apparatus capable of working efficiently regarding both the actual treatment and the environment. This objective is attained with the apparatus of claim 1. The method according to the invention is given in claim 10.

The basic idea of the invention is to provide an apparatus capable of treating, removing, collecting and passing a matter removed from an underwater surface, such that the matter to be removed does not spread into surrounding water. This is resolved in such a way that the apparatus has its brush members fitted in such a manner that, as the brush members are rotating on the underwater surface to be treated, the bristles thereof rotate along the level of the underwater surface and are at least in partial contact with each other in a given contact zone, and in such a manner that the rotating directions of the brush members in the contact zone are towards the discharge opening provided in the enclosure. The brush members with their bristles thus rotate in the plane of the underwater surface to be treated. In addition, the enclosure is provided with a skirt portion surrounding the brush members and setting against the underwater surface to be treated and extending towards and to the discharge opening from both sides thereof. Thus, by means of the rotating brush members, there is also established a suction effect for holding the apparatus against an underwater surface, the arrangement working like a centrifugal pump. The treatment of a surface is perceived to include for example both cleaning and grinding the surface, always in compliance with the surface in question and the purpose of a treatment pertinent thereto.

The skirt portion is preferably made of a flexible material, for example a rubber material. This ensures that the skirt portion is better adapted to follow and set against a surface to be treated and that the skirt portion yields to movements of the enclosure, for example according to the brushing action-generated fluctuation of a vacuum level existing inside the enclosure.

The skirt portion is also preferably provided with a brush member along its edge facing the underwater surface to be treated. The skirt portion ensures a tight fit of the apparatus against the surface to be treated across the entire skirt.

The skirt portion preferably encircles the brush members along the outer edges thereof, such that the skirt portion settles in the proximity of a given contact zone on a side of the enclosure opposite to the discharge opening provided in the enclosure. Thereby is ensured a passage of the removed matter along with the brush members from the underwater surface to the given contact zone.

From the standpoint of providing a highly effective apparatus it is preferred that a location at the discharge opening provided in the enclosure be fitted with guides extending towards the bristles of the brush members. This enables the removed matter to be guided directly from the rotating brush members towards the discharge opening and further into a collection arrangement.

The guides are preferably made of a flexible material, for example a rubber material. Hence, they are better adapted to comply with movements of the skirt portion and to ensure a guidance of the removed matter towards the discharge opening.

In view of leading the matter removed from an underwater surface as effectively as possible towards the opening and further into a collecting arrangement, it is preferred that the discharge opening provided in the enclosure be arranged in the enclosure so as to settle close to the underwater surface to be treated.

The brush members are preferably provided with a hydraulic drive because of this particular operating environment.

It is preferred that the discharge opening provided in the enclosure be capable of having connected therewith from outside the enclosure a discharge pipe, by way of which the matter removed from the underwater surface to be treated can be conveyed into a collecting arrangement, whereby the engagement between the apparatus and the collection arrangement can be readily adapted to each required application.

Preferred embodiments for an apparatus of the invention are defined in claims 2-9. Preferred features for the method of the present invention are defined in claims 11-15.

BRIEF DESCRIPTION OF THE DRAWINGS

The invention will now be described solely by way of example only with reference to the accompanying schematic drawings, in which.

DESCRIPTION

Figure 1:
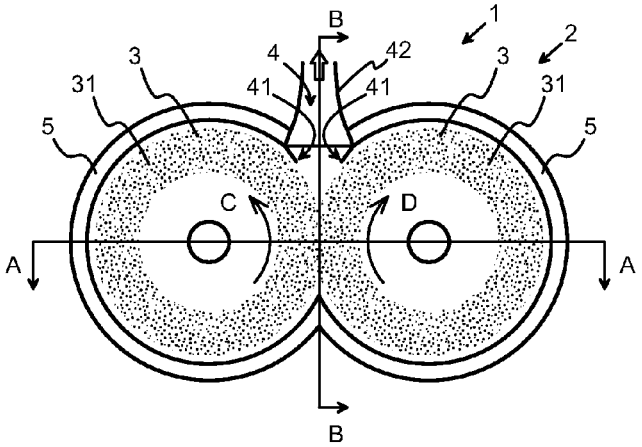
FIG. 1 shows an apparatus of the invention in a view from its side settling on a surface to be treated.
Figure 3:
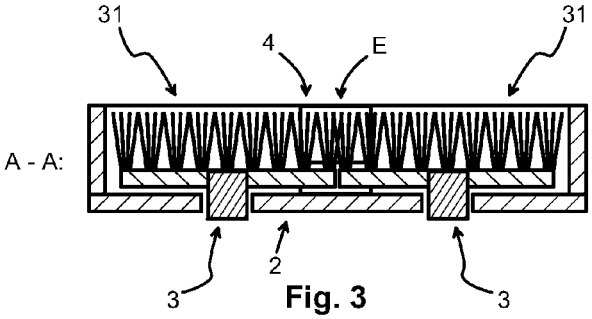
FIG. 3 shows a section A-A in FIG. 1.
Figure 10:
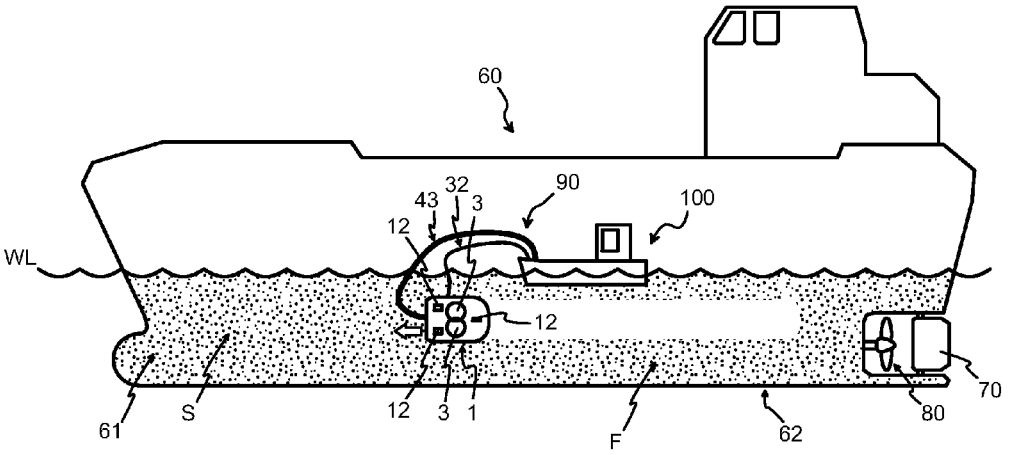
FIG. 10 illustrates one practical application of the invention.

FIGS. 1 and 3 illustrate the portion of an apparatus 1 according to the invention, intended for the treatment of underwater surfaces. The apparatus 1 comprises an enclosure generally indicated with reference numeral 2. The enclosure 2 is fitted with two rotary brush members 3 rotating in directions opposite to each other (indicated with arrows C and D) and equipped with bristles 31. The enclosure 2 is provided with a discharge opening 4 for relieving the enclosure 2 of a matter to be removed from an underwater surface S (FIG. 10). The discharge opening 4 is associated with a collection arrangement 70 for gathering the matter removed from the underwater surface S.

Figure 2:
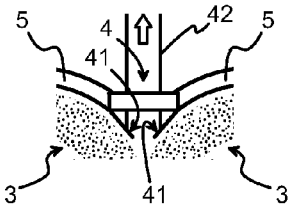
FIG. 2 shows a detail about a discharge opening provided in the apparatus enclosure.

The brush members 3 are arranged in such a way that, as the brush members are rotating on the underwater surface S being treated, the bristles 31 thereof are at least in partial contact with each other in a given contact zone E. The bristles 31 of the rotary brush members 3 rotate along the level of the underwater surface S, whereby the bristles 31 converge in the given contact zone E. In other words the brush members 3 rotate in the plane of or in parallel to a plane of the underwater surface so that each brush member scrub an area corresponding approximately to the diameter of the brush member. This is depicted in more detail in FIG. 4. The brush members 3 have rotating directions (indicated with arrows C and D) in the contact zone E towards the discharge opening 4 provided in the enclosure 2. In addition, the enclosure 2 is provided with a skirt portion 5, surrounding the brush members 3 and setting against the underwater surface to be treated and extending towards and to the discharge opening 4 from both sides thereof and setting against the underwater surface S to be treated. What is primarily illustrated in FIG. 2 is how the discharge opening 4 can be established by means of a pipe element 42 fitted in the skirt portion 5. In a location at the discharge opening 4 provided in the enclosure 2 are preferably fitted guides 41, which extend towards the bristles 31 of the brush members 3.

Figure 5:
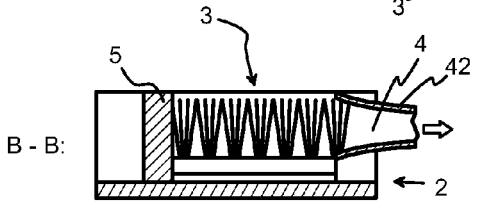
FIG. 5 shows a section B-B in FIG. 1, FIGS. 6 and 7 show various embodiments for a skirt portion of the enclosure.

FIG. 5 shows a section B-B in FIG. 1. What is demonstrated here is how the discharge opening 4 included in the enclosure 2 has been fitted on the enclosure 2 in such a way that, when the apparatus is used for treating an underwater surface, said opening finds a position in the vicinity of the underwater surface S, preferably such that the discharge opening 4 has its edge flush with the surface. What is ensured thereby is that the matter removed by the bristles 31 rotating on the level of the underwater surface S will be guided directly into the discharge opening 4 without obstructions.

The discharge direction from the enclosure 2 for a matter removed from the underwater surface S being treated is indicated with an enlarged arrow in FIGS. 1, 2, 5 and 8.

The guides 41, presented in FIGS. 1 and 2 and associated with the discharge opening 4, make sure that the removed matter is not allowed to travel from the underwater surface along with the bristles 31 of the brush members 3 onto the sides of the apparatus 1, more specifically those of the enclosure 2, away from the discharge opening 4. In this context, another preferred feature is to have the skirt portion 5 encircle the brush members 3 along the outer edges thereof, such that the skirt portion 5 settles in the vicinity of the given contact zone E on a side of the enclosure 2 opposite to the discharge opening provided in the enclosure (FIG. 1). Thereby is ensured a passage of the removed matter from the underwater surface being treated along with the bristles 31 of the brush members 3 to the given contact zone E and further into the discharge opening 4. In addition, this precludes an uncontrolled spreading inside the skirt portion 5 of separate material streams consisting of the matter removed by the brush members 3. This is particularly to avoid a collision of the discussed material streams with the skirt portion 5 or with each other, possibly generating buoyancy inside the enclosure 2. This could push the enclosure 2 away from the presently treated surface S against a vacuum effect established by the rotating brush members 3. This could hamper a sealing engagement of the enclosure 2 against the presently treated surface S achieved by means of the skirt portion 5, in other words, this might lead to a loss of the suction effect generated by means of the rotating brush members 3. Material removed from the underwater surface would also leak from the enclosure into the surrounding environment.

The apparatus could also be provided with a supplementary skirt portion (not shown) that would surround the perimeter or a part of the perimeter of the apparatus itself. For instance, in viewing FIG. 10 (discussed later below in detail) the supplementary skirt portion can be arranged to surround the skirt portion 5 surrounding the brush members 3 as well as also extend around the single hind wheel 12 (to the right side of the drawing). In this way possible residue released from the underwater surface could be controlled in an improved manner as the apparatus is moved forward.

Figure 6:
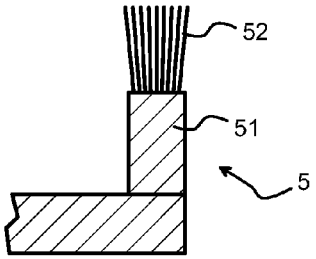
Figure 7:
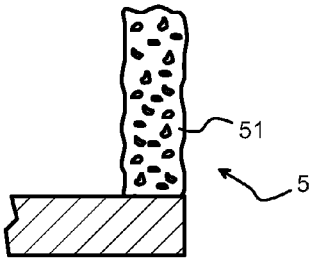

FIGS. 6 and 7 show by way of examples two different embodiments for the skirt portion 5. In FIG. 6, the skirt portion 5 is partially made of a flexible material 51, for example a rubber material. An edge of the skirt portion 5 facing the underwater surface S to be treated is provided with a brush member 52 arranged to set against the underwater surface S. What is ensured by the brush member is that the apparatus has its skirt portion 5 fitting tightly against the surface to be treated regardless of the movements or surface contour or irregularities of the enclosure 2. In FIG. 7, the skirt portion is made entirely of a flexible material 51, for example a rubber material. In normal conditions, this type of skirt portion 5 provides a sufficiently tight fit against the underwater surface S to be treated.

Figure 8:
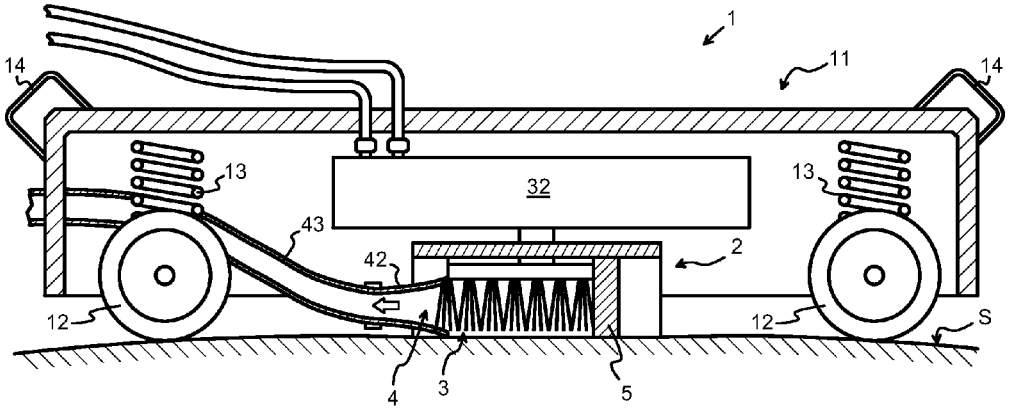
FIG. 8 shows an example of a practical assembly for the apparatus.

FIG. 8 shows by way of example an apparatus 1 of the invention, which is fitted with an enclosure component 2 provided with two brush members 3. The apparatus 1 comes in the form of a carriage 11. The carriage 11 is equipped with wheels 12 supported by a suspension 13. The carriage 11 is provided with handgrips 14. The enclosure 2 has its skirt portion 5 formed with a discharge opening 4 by means of a pipe element 42. Coupled to the pipe element 42 from outside the enclosure 2 is a discharge pipe 43 for conveying the matter removed from a presently treated underwater surface S into a collection arrangement 90 (FIG. 10). The discharge pipe 43 can be rigid or flexible, for example in the form of a discharge hose. Properties of the discharge pipe can always be selected according to each operating condition. In this example, the rotary brush members 3 are provided with a hydraulic drive 32 for rotating the brush members 3 with their bristles 31 against and along the level of the underwater surface. Another suitable type of drive can always be selected according to the intended application of the apparatus.

The collection arrangement 90 can be located, as presented in the example of FIG. 10, on a boat 100 used for controlling the operation of the apparatus 1. The collection arrangement 90 may comprise pump devices, filter devices and other requisite devices (not shown) for the reception and further treatment of collected matter and accompanying water. The collection arrangement may also be positioned equally well for example on a wharf on the pier side or in any other such location. It is also a general practice to use divers for maneuvering such pieces of apparatus 1 on the underwater surface S. In this respect, the handgrips 14 included in the apparatus 1 are highly suitable for controlling the apparatus 1.

Figure 4:
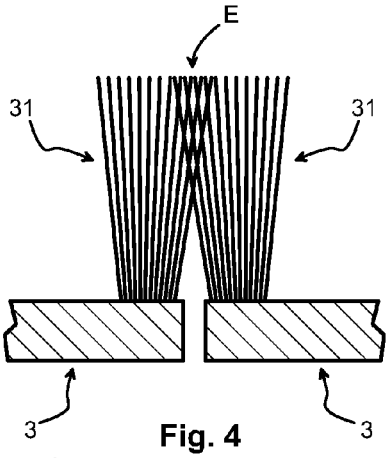
FIG. 4 shows a detail about brush members of the apparatus.
Figure 9:
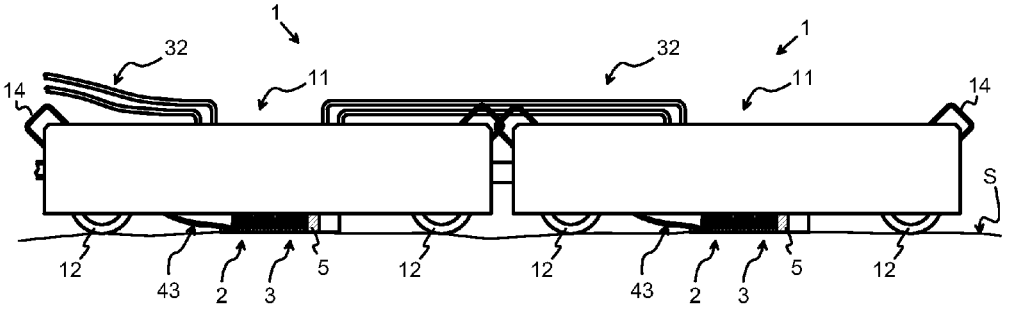
FIG. 9 illustrates one way of interlinking two pieces of apparatus.

Particularly FIGS. 8 and 9 show how the brush members 3 are arranged to rotate on the underwater surface S to be treated, whereby the bristles 31 thereof rotate along the level of the underwater surface. The brush members 3 with their bristles 31, actually the free ends of the bristles, thus rotate in the plane of the underwater surface S to be treated. This is also shown in FIGS. 3-5.

FIG. 9 shows an example of how to interlink two pieces of apparatus 1. Linking two or more pieces of apparatus 1 to each other in parallel, in series, or in some other manner can be beneficial, particularly for speeding up the treatment of large underwater surfaces to be treated. Such arrangements are considered to be known by a person skilled in the art, this example being only intended for clarifying such coupling or linking options.

FIG. 10 clarifies one practical application for an apparatus of the invention by way of example. Reference numeral 60 denotes a marine vessel whose underwater surface S, for example a side 61 or a bottom 62, is being treated. A waterline of the vessel 60 is denoted with reference symbol WL. The apparatus 1 is moved forward along the side 61 of the vessel 60 for cleaning the underwater surface S of matter adhered thereto, for example a fouling F. The width of the underwater surface S covered by the two rotary brush members 3 corresponds largely to the combined diameter of the rotary brush members 3.

The matter removed from the underwater surface S is delivered from the apparatus 1 by way of a pipe system 43 to a collection arrangement 90 located on a boat 100, in which the collected matter and accompanying water can be subjected to a further treatment as necessary.

The apparatus according to the invention can also be deployed in an underwater surface treatment station. In such an arrangement the station could be arranged so that it would have two sides forming a passage for a marine vessel. Apparatuses, which could be of different size and configuration, can be arranged on both sides at different vertical levels, whereby the treatment would be carried out while the marine vessel passes or is moved through the station in a longitudinal direction of the marine vessel. The apparatus movement in a lateral direction against and towards the sides of the marine vessel would be arranged so that the movement would be controlled based on the shape of the marine vessel hull sides, e.g. monitored by sensor equipment. Apparatus with brush members of different coarseness could also be arranged in a longitudinal direction thus firstly providing a rough scrubbing and subsequently a finer scrubbing.

The apparatus 1 according to the invention is also useful, for example, for treating a rudder 70 or a propeller 80 of the vessel 60, for example for cleaning or polishing the same. The above-discussed prior art problems and drawbacks resulting from surface impurities are equally problematic with regard to those. The size of an apparatus can always be adapted to comply with a target of the treatment, a purpose of the treatment, as well as both a type and a contour of the surface.

Next, there will be a brief description of how the actual treatment of an underwater surface can be performed, by using a vessel's side and bottom as an example.

It is a premise, for example, that the vessel 60 has its side 61 and bottom 62 encrusted with a fouling F, which undermines the vessel's performance. In view of cleaning the vessel, the apparatus 1 is taken into the water, for example under the control of a diver, and is placed against the vessel's 60 underwater surface S to be treated. The apparatus 1 is equipped with a hydraulic drive 32 for rotating brush members 3. The hydraulic drive 32 is activated. The brush members 3 provided with bristles 31 begin to rotate as described above and carry out a scrubbing action along the level of the underwater surface S. Rotation of the brush members 3 on the presently treated underwater surface S within the interior of a skirt portion 5 surrounding the brush members 3 generates vacuum in an enclosure 2, whereby the apparatus 1 is drawn into contact with the underwater surface S to be treated.

In the same process, the bottom vegetation and organism fouling F within the area of an underwater surface S covered by the enclosure 2 will be scrubbed off the surface S. The removable matter, along with water contained in the enclosure 2, is pumped by the apparatus 1 operating like a centrifugal pump out through a discharge opening 4 provided in the enclosure 2. The enclosure 2 has its skirt portion 5 encircling tightly the rotating brush members 3, whereby the removed matter is not able to spread in the enclosure 2. In addition, the guides 41 present at the mouth of the discharge opening 4 make sure that the removed matter is guided directly into the discharge opening 4 to be further conveyed therefrom by way of the discharge pipe 43 into the collection arrangement 90 as described above.

The flexible skirt portion 5, which can either be made of a flexible material 51 or which can also be provided with a brush member 52 along its edge facing and setting against the underwater surface S, enables a flow of surrounding water into the interior of the enclosure 2 during the cleaning action, yet in such a manner that the enclosure 2 retains its tight fit against the surface. On the other hand, the combined action of the rotary brush members 3 with their bristles 31 and the skirt portion 5 maintains a vacuum in the enclosure 2, which ensures that removed matter is not able to spread into the surrounding body of water.

It is easy for a diver to steer the apparatus forward along the underwater surface S by using the handgrips 14 included in the apparatus 1. The apparatus movement is assisted by wheels 12 mounted thereon, the motion of which can be balanced for example with a suspension 13.

Accordingly, all the removed matter, and water finding its way into the enclosure 2, can be completely guided into the discharge opening 4 and forward therefrom by way of the discharge pipe 43 into the collection arrangement 90. Thereby is ensured an underwater cleaning operation which does not contaminate the surrounding body of water with the simple and easy-to-use treatment apparatus 1.

In an underwater surface treatment station, the movement of the apparatus would be in a lateral direct against and away from the marine vessel hull sides, whereby the marine vessel would move or be moved in the longitudinal direction.

The drawings and the specification pertinent thereto are only intended to clarify the basic concept of the invention. The details such as the size of the apparatus, its enclosure, and its brush members, the drive for the brush members, the disposition of the opening, the collection arrangement and its components, etc. may vary within the scope of the appended claims.

The invention claimed is:

1. An apparatus for treating an underwater surface, said apparatus comprising:

an enclosure, two brush members fitted in the enclosure and arranged to rotate in directions opposite to each other and equipped with bristles, a skirt portion surrounding the brush members at a level of the underwater surface, whereby the brush members with the bristles are arranged to rotate along said level of the underwater surface, and a discharge opening provided in the enclosure for relieving the enclosure of matter removed from the underwater surface, wherein the skirt portion is arranged to extend to the discharge opening from both sides thereof, and wherein the discharge opening is fitted in connection with the skirt portion and is thus arranged so that, when the brush members are rotating on the underwater surface to be treated, the discharge opening is arranged to settle at said level of the underwater surface to be treated, and whereby the bristles of the brushes are at least in partial contact with each other in a contact zone at said level of the underwater surface to be treated and in such a manner that the rotating directions of the brush members in the contact zone are towards the discharge opening.

2. The apparatus according to claim 1, wherein the skirt portion is made of a flexible material.

3. The apparatus according to claim 2, wherein the skirt portion is provided with a brush member along its edge facing the underwater surface to be treated.

4. The apparatus according to claim 1, wherein the skirt portion encircles the brush members along outer edges thereof, and that the skirt portion settles in the proximity of the contact zone on a side of the enclosure opposite to the discharge opening provided in the enclosure.

5. The apparatus according to claim 1, wherein a location at the discharge opening provided in the enclosure is fitted with guides extending towards the bristles of the brush members.

6. The apparatus according to claim 5, wherein the guides are made of a flexible material.

7. The apparatus according to claim 1, wherein the brush members are provided with a hydraulic drive.

8. The apparatus according to claim 1, wherein the discharge opening provided in the enclosure is capable of having connected therewith, from outside the enclosure a discharge pipe for conveying the matter removed from the underwater surface to be treated into a collection arrangement.

9. A method for the treatment of an underwater surface using an apparatus; which includes an enclosure, two brush members fitted in the enclosure, rotating in directions opposite to each other and equipped with bristles, and a skirt portion surrounding the brush members at a level of the underwater surface, said method comprising the steps of:

positioning a discharge opening of the apparatus, in connection with the skirt portion, at a level of the underwater surface to be treated, conveying matter to be removed from the underwater surface into the discharge opening included in the enclosure of the apparatus, rotating the brush members with the bristles of the apparatus along the level of the underwater surface, wherein the bristles of the brushes are at least in partial contact with each other in a contact zone at the level of the underwater surface to be treated and are rotated in a direction towards the discharge opening, and generating a vacuum for holding the enclosure of the apparatus in a tight fit against the underwater surface to be treated by rotating the brush members in opposite directions, together with a skirt portion encircling the brush members, extending to the discharge opening from both sides thereof and settling against the underwater surface to be treated.

10. The method according to claim 9, wherein the skirt portion of the apparatus is made of a flexible material.

11. The method according to claim 9, further comprising directing the removed matter by guides towards the discharge opening.

12. The method according to claim 9, wherein the brush members are rotated by means of a hydraulic drive.

13. The method according to claim 9, further comprising conveying the matter removed from a presently treated underwater surface from the discharge opening by way of a discharge pipe into a collection arrangement.

14. The apparatus of claim 6, wherein the flexible material is rubber.

* * * * *